US007257906B2

(12) United States Patent
Jones et al.

(10) Patent No.: US 7,257,906 B2
(45) Date of Patent: Aug. 21, 2007

(54) VENTILATED FOOTWEAR WITH A REVERSIBLE TONGUE

(75) Inventors: Lindell B. Jones, Wildwood, MO (US); Raymond F. Tonkel, Sudbury, MA (US)

(73) Assignee: U Turn Sports Co, LLC, Wildwood, MO (US)

( * ) Notice: Subject to any disclaimer, the term of this patent is extended or adjusted under 35 U.S.C. 154(b) by 455 days.

(21) Appl. No.: 11/017,251

(22) Filed: Dec. 20, 2004

(65) Prior Publication Data

US 2005/0102856 A1 May 19, 2005

Related U.S. Application Data

(60) Continuation-in-part of application No. 10/896,393, filed on Jul. 22, 2004, and a continuation-in-part of application No. 10/720,317, filed on Nov. 24, 2003, now Pat. No. 7,028,420, and a continuation-in-part of application No. 10/437,140, filed on May 13, 2003, now abandoned, which is a division of application No. 10/122,995, filed on Apr. 11, 2002, now Pat. No. 6,574,887.

(60) Provisional application No. 60/575,850, filed on Jun. 1, 2004, provisional application No. 60/491,343, filed on Jul. 29, 2003, provisional application No. 60/442,817, filed on Jan. 28, 2003, provisional application No. 60/430,967, filed on Dec. 4, 2002, provisional application No. 60/285,693, filed on Apr. 24, 2001.

(51) Int. Cl.
*A43B 7/08* (2006.01)

(52) U.S. Cl. ..... 36/3 R; 36/54

(58) Field of Classification Search ..... 36/3 R, 36/3 A, 45, 54, 100
See application file for complete search history.

(56) References Cited

U.S. PATENT DOCUMENTS

| | | | | |
|---|---|---|---|---|
| 418,966 | A | 1/1890 | Welander | |
| 752,254 | A | 2/1904 | Patton | |
| 760,401 | A | 5/1904 | Sandmeyer | |
| 911,740 | A | 2/1909 | Montgomery | |
| 1,394,348 | A | 10/1921 | Pietrowski | |
| 1,797,309 | A | 3/1931 | Wojciechowski | |
| 2,049,347 | A | 7/1936 | Benjamin | |
| 2,614,339 | A | 10/1952 | Herceg | |
| 4,372,060 | A | 2/1983 | Adamik | |
| 4,805,321 | A | 2/1989 | Tonkel | |
| 4,837,948 | A | 6/1989 | Cho | |
| 5,357,689 | A | 10/1994 | Awai | |
| 5,365,677 | A * | 11/1994 | Dalhgren | 36/3 A |

(Continued)

*Primary Examiner*—Marie Patterson
(74) *Attorney, Agent, or Firm*—Paul M. Denk

(57) ABSTRACT

The present invention pertains to footwear where the tongue may be reversed in order to open and close vents in the upper of a shoe. Secondarily, the reversible tongue changes the aesthetics, coloration, indicia, or other appearance of the footwear. A shoe has an upper upon a sole. On the sides of the upper, generally vertical stripes have vent between them. The reversible tongue has a symmetric shape and it rotates upon a longitudinal axis. Placed within the upper upon a swivel, the tongue rotates to extend across the vents to close them and to retreat from the vents to open them. In rotating, the tongue changes the coloration, indicia, design, or other appearance aspects of the shoe. Rotation of the tongue occurs with shoe laces loosened or with removal of a foot from the shoe.

8 Claims, 3 Drawing Sheets

U.S. PATENT DOCUMENTS 5,551,172 A 9/1996 Yu
6,711,832 B2 * 3/2004 Chen ..... 36/3 R
2004/0006889 A1 * 1/2004 Chen ..... 36/3 R
2005/0160622 A1 * 7/2005 Chen ..... 36/3 A

* cited by examiner

VENTILATED FOOTWEAR WITH A REVERSIBLE TONGUE

CROSS REFERENCE TO RELATED APPLICATION

This continuation-in-part patent application claims priority as a continuation-in-part of the application having Ser. No. 10/896,393, which was filed on Jul. 22, 2004 which application is derived from a provisional application having Ser. No. 60/491,343 which was filed on Jul. 29, 2003; this application claims priority upon the provisional application for patent having Ser. No. 60/575,850, filed on Jun. 1, 2004; this application is a continuation in part of the patent application having Ser. No. 10/720,317, filed on Nov. 24, 2003, now U.S. Pat. No. 7,028,420 which application claims priority upon the provisional application for patent having Ser. No. 60/430,967, filed on Dec. 4, 2002 and further claims priority upon the provisional application for patent having Ser. No. 60/442,817 which was filed on Jan. 28, 2003; and, also is a continuation-in-part and claims priority upon the patent application having Ser. No. 10/437,140, which was filed on May 13, 2003 now abandoned which application is a division of the non-provisional patent application having Ser. No. 10/122,995 filed on Apr. 11, 2002, now U.S. Pat. No. 6,574,887 that issued on Jun. 10, 2003, which patent claims priority from provisional application for patent having Ser. No. 60/285,693, filed Apr. 24, 2001;

all patents and applications above are owned by a common Assignee.

BACKGROUND OF THE INVENTION

This invention relates generally to footwear, and more specifically pertains to shoes and the like where the tongue may be reversed, in order to ventilate a shoe and to change the aesthetics, coloration, indicia, or other appearance of the overall footwear.

Numerous styles of footwear, constructed of various components and for achieving multiple purposes, have long existed in the prior art. Most of these types of innovations have been in the area of running or athletic shoes which have enjoyed resurgence in recent years. Various styles or modifications to the shoes, as in their tongue configurations, to make them more comfortable, more resilient, add to the efficiency of the runner or suitable to fashion have been considered in the prior art. Shoes as a class borrow various accessories and modifications from other footwear, such as tongue flaps.

Recent trends have even considered reversing various components of footwear, such as tongues, to alter the aesthetics of, to change the style of, and to improve the appearance of footwear when worn. Modifications to the structure of the shoe itself, such as adding pockets to the side or within the tongue or gusset of the shoe, have been considered in the prior art. For example, the patent to Adamik, U.S. Pat. No. 4,372,060, relates to this type of technology, and its modifications. Then the patent to Benjamin, U.S. Pat. No. 2,049,347, shows a shoe wherein a strap, held by one or more D-Rings, can be turned to reverse the positioning of the strap within the shoe structure. In addition, the patent to Tonkel, U.S. Pat. No. 4,805,321, shows the use of a separable tongue held by Velcro to its vamp, but which must be removed to provide for its turning and to vary the appearance of the shoe. However, shoes have retained their basic form of an upper upon a sole including a tongue over the instep of a foot.

The current invention modifies the tongue and upper of footwear or shoes, particularly athletic shoes. The modifications add further variations in the use of the shoe, enhance its styling, and further enhance the comfort of a foot within the shoe, by providing ventilation to its components particularly the tongue, when structured into the shoe itself.

SUMMARY OF THE INVENTION

This invention relates generally to footwear such as laced shoes, sneakers, boots and the like. The footwear includes, but is not limited to, the usual style of shoe having a sole, vamp, quarter portions, counter, and a tongue or gusset secured therein. In the preferred embodiment, the gusset will be of a reversible type, where the tongue can be turned to expose one surface, which may have a stylized and attractive surface provided thereon, or the tongue may be reversed, to furnish an entirely different appearance to the shoe, when worn. The present invention specifically reverses the tongue of footwear to open and close vents in the upper of a shoe as well as alter the coloration, indicia, or other appearance.

Means are provided to accommodate the reversing of the tongue, and to hold it to the upper vamp portion of the shoe. The tongue which can be readily turned, simply upon opening of its fastening feature, or clasp, which normally holds the tongue in position, while the shoe is worn. The tongue may also have on one surface a transparent covering, at least approximate its upper edge as desired by the wearer.

The footwear has this invention embodied within its structure, as readily determined. In this invention, a select component of shoes will be reversible, structurally, as embodied within the manufactured shoe. In the preferred embodiment, a shoe will have a tongue that reverses upon manipulation by the wearer, where the tongue rotates upon an off center axis to expose one surface, which may have a stylized and attractive surface provided thereon and to open the vents, or it may be reversed, to furnish an entirely different appearance to the shoe and to close the vents. The tongue joins to the upper and is designed to cover the instep of a foot. Rotation of the tongue occurs with a foot removed from the shoe or with laces loosened on the shoe.

The concept of this invention is a reversible tongue with an asymmetric shape provided upon a link fixed to the upper vamp of a shoe. The tongue lets the wearer reverse it for revealing other coloration, indicia, or design and opening and closing vents in the upper as desired by the wearer. Such a linkage means could comprise a short piece of cord, it may be an elastic cord, or perhaps could comprise a swivel clasp, or other type of clasp, having some degree of flexibility, and which may be twisted or turned. In addition, it may include a clasp, formed of two parts that may swivel, and be interconnected between the upper vamp, and the bottom of the shoe gusset, to accommodate such turning motion. It provides versatility to the appearance of the shoe. The tongue comprises similar material as the upper commonly leather, nylon, rubber, or other sturdy material.

Further, the link or clasp may be separable, through the exertion of some amount of force, so that the gusset may be removed, and another one relocated, to add further dexterity and versatility to the usage of this invention. In order to prevent the unauthorized removal, or the displacement of the tongue, from the shoes, as for example, when displayed for sale, the pulling force required to separate the clasp may be excessive, up to eighty pounds or more, or it may only require a slight amount of force, to separate the clasp, at the desire of the manufacturer, the retailer, and even the user, once the shoes are placed in usage. It is also likely that the tongue may be a compound, or more, style of tongue, having a swivel means between each of the sections of the tongue or gusset, to allow for turning, of just segments, of the tongue, along its height.

It is, therefore, a primary object of this invention to provide a reversible tongue for footwear.

Another object of this invention to provide a reversible tongue that regulates ventilation of the upper of a shoe, sneaker, boot, or other laced footwear.

Another object of this invention is to provide a reversible tongue that may have different styles of appearance upon either of its surfaces, so that the tongue can be reversed, and completely change the appearance and attractiveness of the shoe, to the interest of the footwear wearer. For example, the consumer can coordinate with team colors, fashion trends, and the like.

Still a further object of this invention is to provide footwear, in the category of walking shoes, running shoes, beach shoes, casual or dress shoes, boots, hikers, and even athletic shoes, which may comprise either baseball, football, track, soccer, basketball, and any of the variety of other athletic sports that incorporate particular styled shoes, incorporating the reversible tongue of this invention which adds to the versatility of the appearance and usage of the footwear.

Another object of this invention is an athletic shoe with a reversible tongue so that the coloration on one surface of the tongue may be used, for example, for home games, while the opposite side may be of another color, for away games.

Still another object of this invention is to provide a swivel that can be used for applying the reversible tongue to the upper central portion of the shoe vamp, to stably hold the tongue in place, while the shoe is being worn.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated a preferred embodiment of the invention.

BRIEF DESCRIPTION OF THE DRAWINGS

In referring to the drawings.

The same reference numerals refer to the same parts throughout the various figures.

DESCRIPTION OF THE PREFERRED EMBODIMENT

Figure 1:
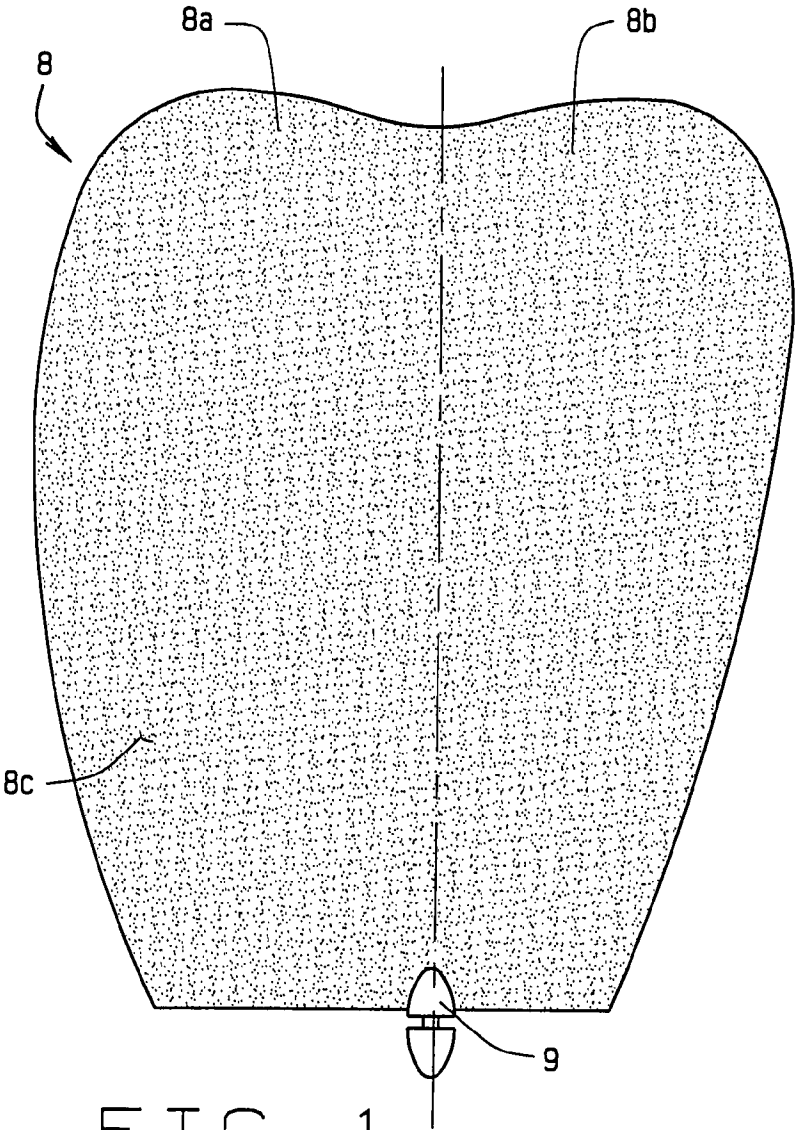
FIG. 1 is a top view of the obverse face of the tongue according to the present invention.

In referring to the drawings, and in particular FIG. 1, the concept of the present invention 1 has a tongue 8 of a generally planar shape with an obverse and an opposite reverse face 8*d*. More particularly, the tongue 8 has an asymmetric shape about the longitudinal axis resulting in a wide portion 8*a* and a narrow portion 8*b*. Here the narrow portion 8*b* is shown towards the right of FIG. 1. The tongue 8 shape appears as an elongated but truncated cardioid. The tongue 8 has a width proximate to the ankle of the shoe wearer and then tapers as the truncated portion of the cardioid abuts the vamp 4 of a shoe.

The tongue 8 attaches by means of a connection or clasp 9 and holds the tongue 8 in place, whichever side of the reversible tongue 8 is desired to be exposed upwardly, when the footwear 1 is worn. The clasp 9 is located upon the longitudinal axis of the tongue 8 proximate to the toe. The longitudinal axis extends from the clasp 9 and up the length of the tongue 8, or extends up the instep of a foot. The clasp 9 has one or more components as a ball and socket connection. The ball portion 9*a* attaches to the tongue 8 and the socket portion 9*b* attaches to the vamp 4.

Figure 2:
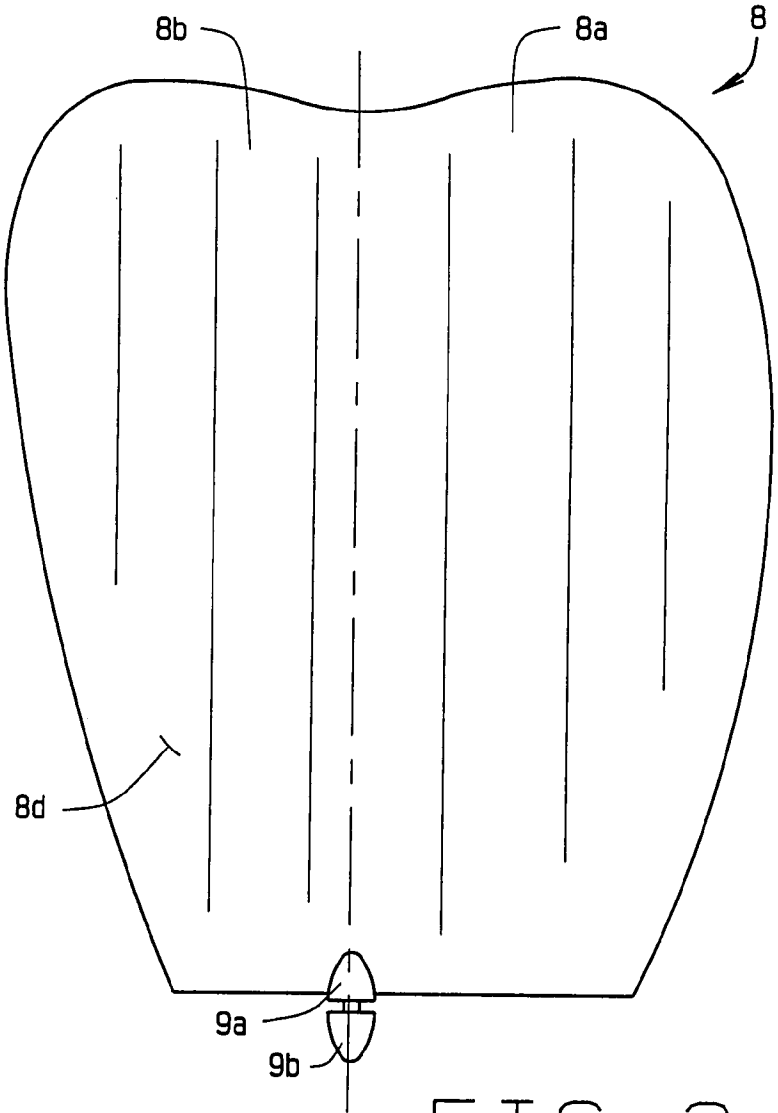
FIG. 2 is another view of the reverse face of the tongue in accordance with the present invention.

FIG. 2 shows the reversible tongue 8 with the reverse face 8*d* shown. Upon turning the tongue 8 upon the clasp 9, the obverse face 8*c* turns to reveal the reverse face 8*d*. The obverse and reverse faces 8*c, d* may have different indicia, coloration, or markings to meet a desired design or fashion. Viewing the obverse face 8*c*, the wide portion 8*a* of the tongue 8 is shown towards the right of FIG. 2.

Figure 3:
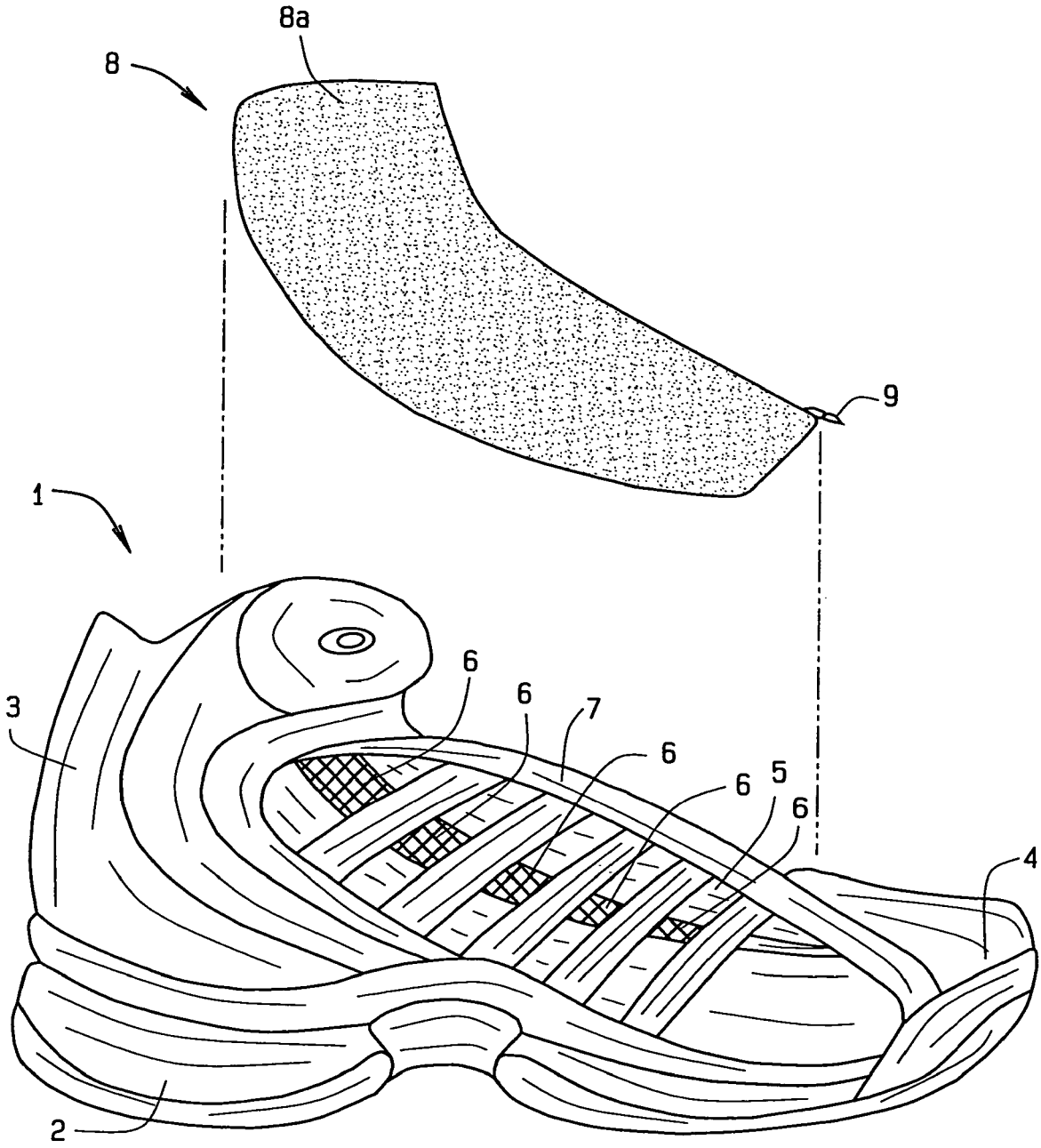
FIG. 3 is an exploded view of a shoe and a tongue as in the present invention.

Moving from the tongue alone, FIG. 3 shows the tongue 8 in relation to a shoe. Though an athletic or running shoe is shown, the present invention 1 applies to many types of shoes or boots. A shoe 1 incorporates the usual components including the sole 2, its vamp 4, the quarter portions, and a counter 3. The upper 5 has a plurality of stripes upon one or both sides 7. The stripes extend upwards from proximate to the sole 2 towards the instep. The stripes may or may not be at an angle to the vertical to suit a desired fashion. Between adjacent stripes, the shoe has vents 6, generally rectangular in shape. Admitting air, the vents 6 are covered with a mesh material or alternatively a screen, grouping of holes, or are completely open.

The reversible tongue 8 is also disclosed with the wide end towards the opening of the shoe or ankle vicinity and the clasp 9 towards the vamp 4 or toe vicinity. The reversible tongue 8 is applied by a clasp 9 to the upper 5 central portion of the vamp 4, and cooperates to hold the tongue 8 in place, whichever side of the reversible tongue 8 is desired to be exposed upwardly, when the footwear 1 is worn. The tongue 8 may contain some indicia, coloration or a trademark, upon its obverse face 8*c* as desired for fashion. In addition, the reverse face 8*d* of the reversible tongue 8 may contain other indicia or styling, as may be desired by the footwear 1 designer or the shoe wearer. The indicia can be applied to the upper 5 portion of the reversible tongue 8, or along its entire upper 5 surface.

While the preferred embodiment shows a swivel 9 as the means for clasping the reversible tongue 8 to the upper 5 center portion of the shoe vamp 4, it is just as likely that, instead of using a swivel 9, the reversible tongue 8 may snap directly to the upper 5 edge of the vamp 4. The reversible tongue 8 has a snap upon the lower portion of both faces, so that it can be snapped directly to the vamp 4, regardless which face of the reversible tongue 8 is desired to be arranged upwardly, simply through the efforts of the footwear 1 owner, by releasing the tongue 8, reversing it, and snapping it back into a fixed position, relative to the shoe vamp 4. Or, the tongue 8 might be held by other means of connection, such as by a tie means, a Velcro® strip or any other means for firmly holding the tongue 8 in place, for use in displaying whatever surface of the tongue 8 is desired to be shown.

Figure 4:
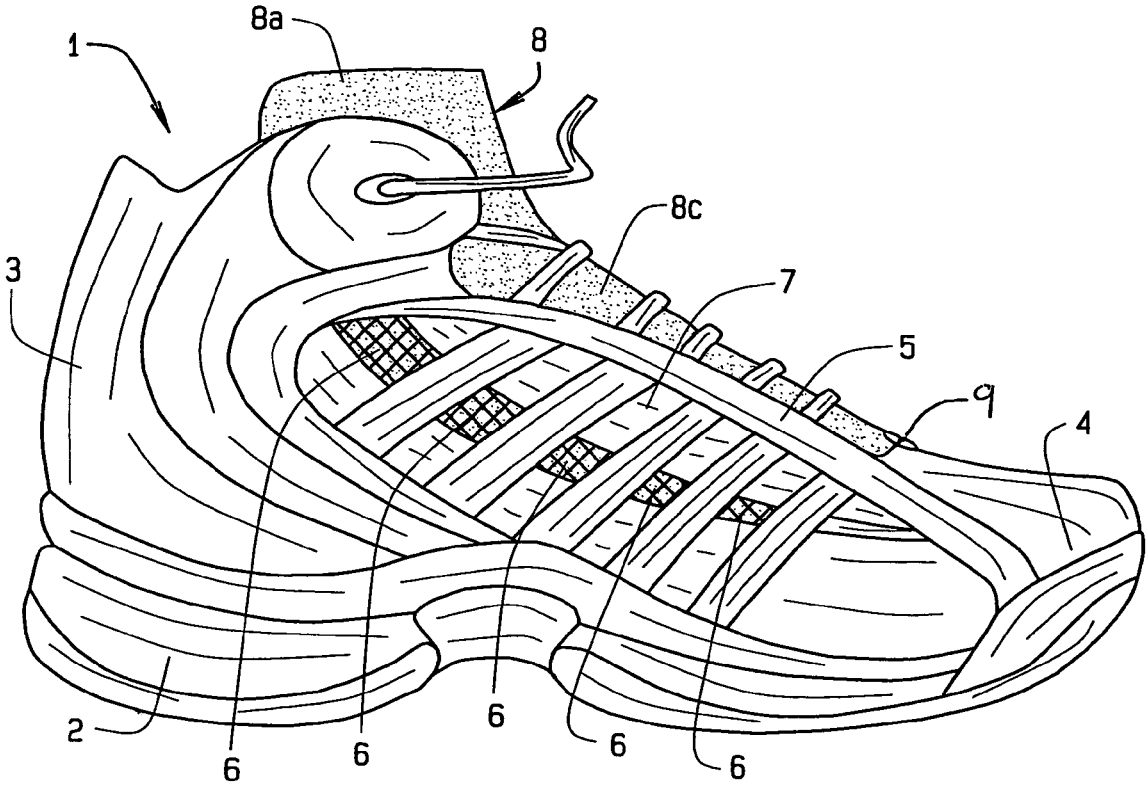
FIG. 4 is an isometric view of a shoe and a tongue with the obverse face upwards as in the present invention; and, FIG. 5 is another isometric view of a shoe with an alternate embodiment of vents and a tongue with the reverse face upwards as in the present invention.

Turning to FIG. 4, an athletic shoe is shown with the present invention 1 installed. The tongue 8 installs within the shoe over the instep. The narrow end of the tongue 8 connects to the vamp 4 and extends upward and along the length of the shoe towards the ankle with the wide end of the tongue 8. Here the tongue 8 has the obverse face 8*c* upwards and visible. The wide portion 8*a* of the tongue 8 extends over the instep and towards the arch of the foot. The wide portion 8*a* of the tongue 8 traverses behind the vents 6 and closes the vents 6 to the passage of air. In this figure, the vents 6 are shown as mesh material through the upper 5 which makes the tongue 8 visible through the vent 6, here shown as the dotted obverse face 8*c* of the tongue 8. Alternatively, the vents 6 may be completely open through the upper 5. The wide portion 8*a* of the tongue 8 seals each vent 6 entirely.

Figure 5:
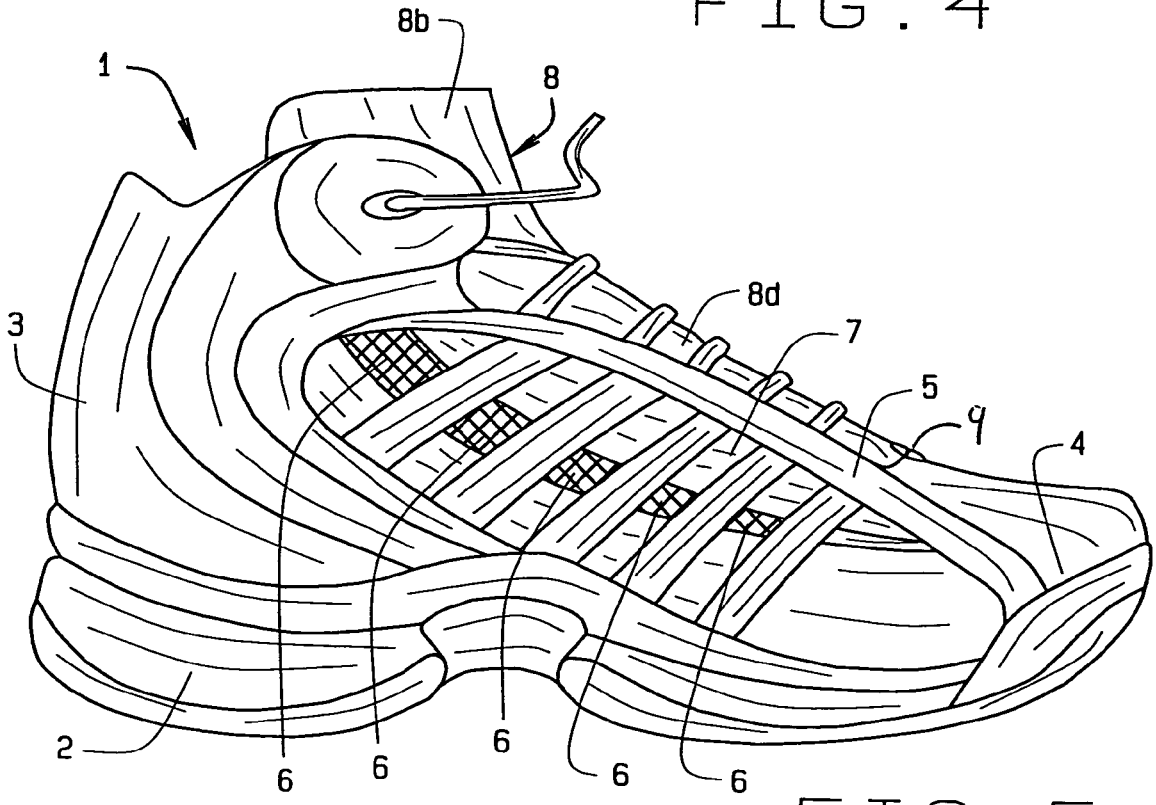

When the wearer of the shoe reverses the tongue 8, the narrow portion 8*b* of the tongue 8 abuts the upper 5 edge of the vents 6 that remain open to the passage of air as shown in FIG. 5. Again an athletic shoe has the present invention 1 installed as a reversible tongue 8 over the instep. The narrow end of the tongue 8 connects to the vamp 4 and the wide end of the tongue 8 abuts the ankle. Here the tongue 8 has the reverse face 8*d* upwards and visible. The wide portion 8*a* of the tongue 8 extends over the instep and toward the arch of the foot. The narrow portion 8*b* of the tongue 8 extends away from the arch but does not reach the vents 6. The vents 6 remain open to the passage of air. In this figure, the vents 6 are shown as mesh material through the upper 5 which makes the mesh visible in the absence of the tongue 8. The narrow portion 8*b* of the tongue 8 opens each vent 6 entirely.

From the aforementioned description, footwear ventilation by a reversible tongue has been described. The reversible tongue is uniquely capable of opening and closing vents on the upper and of changing the visible appearance of a shoe. The reversible tongue and its various components may be manufactured from many materials including but not limited to polymers, high density polyethylene, polypropylene, polyethylene terephalate ethylene, leather, nylon, metallic foils, and composites.

Variations or modifications to the subject matter of this invention may occur to those skilled in the art upon reviewing the disclosure as provided herein. Such variations, if within the spirit of this development, are intended to be encompassed within the scope of any claims to the invention provided within this patent. The description of the preferred embodiment, as also depicted in the drawings, is set forth herein for illustrative purposes only.

The phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. Therefore, the claims include such equivalent constructions insofar as they do not depart from the spirit and the scope of the present invention.

We claim:

1. Ventilated footwear that has a sole, counter, and vamp, the ventilated footwear comprising:

an upper attaching to the sole and extending away from the sole, having one or more vents in one or both sides of said upper; and, a tongue pivotally attaching to the vamp and within said upper, extending away from the vamp, having an off center longitudinal axis, and rotating upon the longitudinal axis, and having obverse and reverse faces;

whereby said tongue opens said vents when said tongue is away from said vents and closes said vents when said tongue is behind said vents.

2. The ventilated footwear of claim 1 further comprising:

a ball and socket connection having a ball portion attached to said tongue and a socket portion attached to the vamp wherein said ball is rotatably secured within said socket; and, said tongue having a wide portion to one side of the longitudinal axis and a narrow portion opposite said wide portion;

whereby said tongue may be rotated about the longitudinal axis to alternatively expose an obverse and a reverse face of said tongue;

whereby said wide portion closes said vents and said narrow portion opens said vents.

3. The ventilated footwear of claim 2 wherein said tongue is an elongated and truncated cardioid.

4. The ventilated footwear of claim 2 wherein said vents are open through the upper.

5. The ventilated footwear of claim 2 wherein said vents are mesh.

6. Footwear has a sole with an attached counter, upper with two sides, and vamp that allows air to reach a foot within the footwear, wherein the improvement comprises:

said upper having one or more vents in one or both sides; and, a tongue pivotally attaching to the vamp, locating within said upper, extending away from the vamp, and having an off center longitudinal axis and rotating upon the longitudinal axis;

whereby said tongue closes said vents when said tongue moves behind said vents and opens said vents when said tongue moves away from said vents.

7. The ventilated footwear of claim 6 further comprising:

a pivotal connection having a first part attached to said tongue and a second part attached to the vamp wherein said first part is rotatably secured within said second part; and, said tongue having a wide portion to one side of the longitudinal axis and a narrow portion opposite said wide portion;

whereby said tongue rotates about the longitudinal axis to alternatively expose an obverse and a reverse face of said tongue;

whereby said wide portion closes said vents and said narrow portion opens said vents.

8. The ventilated footwear of claim 7 wherein said first part is a ball, said second part is a socket, and said vents are one of open, mesh, screen, or grouping of holes.

* * * * *